US009038551B2

(12) United States Patent
Corbani

(10) Patent No.: US 9,038,551 B2
(45) Date of Patent: May 26, 2015

(54) WASTE DISPOSAL PLANT WITH MODULAR FRAME AND GUIDE ASSEMBLY

(75) Inventor: Emanuele Corbani, La Spezia (IT)

(73) Assignee: TM.E. S.p.A., La Spezia (IT)

( * ) Notice: Subject to any disclaimer, the term of this patent is extended or adjusted under 35 U.S.C. 154(b) by 53 days.

(21) Appl. No.: 13/511,982

(22) PCT Filed: Nov. 18, 2010

(86) PCT No.: PCT/EP2010/007012
§ 371 (c)(1),
(2), (4) Date: Oct. 2, 2012

(87) PCT Pub. No.: WO2011/063910
PCT Pub. Date: Jun. 3, 2011

(65) Prior Publication Data

US 2013/0014679 A1 Jan. 17, 2013

(30) Foreign Application Priority Data

Nov. 26, 2009 (IT) ..... TO2009A0916

(51) Int. Cl.
*F23H 7/08* (2006.01)
*F23H 17/08* (2006.01)
*F23G 5/00* (2006.01)

(52) U.S. Cl.
CPC ..... *F23G 5/002* (2013.01); *F23G 2203/101* (2013.01); *F23H 7/08* (2013.01); *F23H 17/08* (2013.01)

(58) Field of Classification Search
CPC ..... F23H 1/02; F23H 7/02; F23H 7/04; F23H 7/12; F23H 7/14; F23H 7/18; F23H 17/08
USPC ..... 110/255, 257, 248, 281, 282, 283, 284, 110/291; 126/174, 175
See application file for complete search history.

(56) References Cited

U.S. PATENT DOCUMENTS

| | | | | |
|---|---|---|---|---|
| 1,759,042 | A | 5/1930 | De Carie | |
| 4,018,168 | A * | 4/1977 | Andreoli et al. | 110/268 |
| 4,366,802 | A * | 1/1983 | Goodine | 110/108 |
| 4,598,651 | A * | 7/1986 | Flickinger et al. | 110/280 |

(Continued)

FOREIGN PATENT DOCUMENTS

| | | |
|---|---|---|
| DE | 17 51 421 | 2/1971 |
| DE | 94 11 363 | 11/1995 |

(Continued)

OTHER PUBLICATIONS

International Search report from International Application No. PCT/EP2010/007012 mailed Jun. 8, 2011.

*Primary Examiner* — David J Laux
(74) *Attorney, Agent, or Firm* — Merchant & Gould P.C.

(57) ABSTRACT

A waste disposal plant includes a combustion chamber (2) inside which waste laid on a combustion grate (3) is burnt. The grate permits the entrance of an adequate quantity of combustion air in the chamber through it. The combustion grate includes at least a handling group formed by fire bars or plates (7), which move alternatively one with respect to the other by advancing the waste on the grate. A handling group allows the alternate movement of the fire bars (7) which are divided in movable fire bars (7*a*) and fixed fire bars (7*b*), alternately disposed one with respect to the other, on transversal rows resting one upon the other according to a longitudinal placement with alternate steps.

4 Claims, 4 Drawing Sheets

(56) References Cited

U.S. PATENT DOCUMENTS

| | | | | | |
|---|---|---|---|---|---|
| 4,656,956 | A | | 4/1987 | Flickinger et al. | |
| 4,671,190 | A | * | 6/1987 | Moreau | 110/281 |
| 4,793,471 | A | * | 12/1988 | Bartels | 110/281 |
| 5,269,287 | A | * | 12/1993 | Krieger | 110/281 |
| 6,024,031 | A | * | 2/2000 | Stiefel | 110/281 |

FOREIGN PATENT DOCUMENTS

| | | |
|---|---|---|
| EP | 1 635 114 | 3/2006 |
| WO | WO 2008/000047 | 1/2008 |

* cited by examiner

PRIOR ART

WASTE DISPOSAL PLANT WITH MODULAR FRAME AND GUIDE ASSEMBLY

This application is a National Stage Application of PCT/EP2010/007012, filed 18 Nov. 2010, which claims benefit of Serial No. TO2009A000916, filed 26 Nov. 2009 in Italy and which applications are incorporated herein by reference. To the extent appropriate, a claim of priority is made to each of the above disclosed applications.

BACKGROUND

The present invention relates to a combustion grate, having a modular frame, and being installed in the furnace of a waste disposal plant, in which the aforesaid waste is burnt and so disposed of as ashes.

Such disposal generally comprises also an energy recovery system through the production of overheated steam and the exploitation of steam in a turbine, which in turn is coupled to an electric generator.

Such plants generally comprise a combustion chamber inside which the waste laid on a combustion grate is burnt, through which an adequate quantity of air is inputted. The combustion grate is adapted to sustain and advance the waste during the combustion permitting at the same time the insufflations of combustion air under the waste bed. The grate forms the lower portion of the combustion chamber. The combustion chamber begins physically immediately above the grate. In some cases, the walls of the combustion chamber are completely or partially cooled, by means of evaporation tube bundles protected by the refractory material itself. The region at the interface between grate and combustion chamber is made by the refractory-carrying beam. Inside the combustion chamber, the flame produced by the combustion of waste is spread, reaching temperatures over 1400° C. The surface of the grate is hit only occasionally by the radiation of the flame, as it is normally protected by the waste bed in transit.

The surface of the grate is made by plates (typically known as "fire bars") which are normally made of molten steel having a high chromium content, in order to show high wear characteristics when hot. The advancement of waste is obtained through the relative movement of the fire bars which can have several characteristics. The actuation system is normally made of hydraulic pistons. The fire bars are provided with apertures or holes to allow the combustion air to flow from underneath the plane of the grate, through the waste. The combustion air has in fact the double function of providing the oxygen for the oxidation of the waste and of cooling the fire bar by maintaining it at an acceptable temperature in order to maintain the mechanical characteristics. The cooling is necessary, as the grates normally work covered by the forwarded fuel, but they can also be directly exposed to the combustion flames.

The steps making the grate can also be provided with an additional cooling system with water, particularly when they are used for the combustion of fuels with high calorific power. Such cooling is obtained by a liquid circulation which is forced to lap the surfaces which do not contact the fuel of each fire bar, through a liner or an equivalent apparatus for the accumulation of liquid.

The fire bars at the initial and terminal ends of each step are separated from the carrying structure of the grate by means of plates, generally of the same material of the fire bar, which are approached with pressure against the side of the side bar itself. Such plates have the function of laterally containing the fuel forwarded in the region immediately above the fire bars, and of separating it from the lateral portions of the grate, which do not tolerate the direct exposition to the burning material. The lateral plates eventually join the plane made by the fire bars with the vertical surfaces of the combustion chamber, which are disposed immediately above the grate.

The grate further comprises a plurality of handling groups, each formed by the cited fire bars organized in bundles, which relatively move one with respect to the other advancing the waste on the grate. In particular, the fire bars are divided into fixed and movable fire bars, which through slides cause a back-and-forth movement, by sliding one on another and determining the advancement of the waste in each handling group, and so in general on the grate.

The disposal of the solid urban waste, even if it is not characterized by a highest technological content, is an activity particularly sensible from a point of view of the reliability and the guarantees of the function. The complex integrated system of the waste disposal (the accumulation, the collection, the transport, the storing and the disposal) requires that the technological components employed in the last stage of the supply chain permit a continuous operation over hours and minimize the risks of stopping due to damages (minor or catastrophic damages as they can be). The operator of the disposal plant requires to the component "grate" to be reliable, robust and simple, both in the operation and in the maintenance stage.

Patent application MI2004A001746 describes a plant of this kind having a movable combustion grate, in which the handling group is formed by a plurality of fire bars or plates, which alternatively move one with respect to the other by advancing the waste on said grate, which realizes a substantially horizontal and at least partially continuous combustion plane.

The Applicant has observed that in such kind of technological solution the handling means of the fire bars, the sliding elements for the movable frame which supports the movable fire bars and the elements limiting the movement of the same, be in fact positioned in mutually remote regions of the grate, by making it necessary to dedicate to each of them an element separate from the carrying frame in order to support them. Furthermore, the elements limiting the movement are positioned along the symmetry axis of the module. This kind of assembly makes the rotary parts of the sliding and limiting elements particularly exposed to the unavoidable fall of ashes within the pressurized volume with the increase of the risk of malfunctions. Such positioning of the element makes further difficult the inspection, the maintenance and the lubrication of the rotary parts which must be reached by suitable tubing for the injection of the lubricant. Finally, the cited elements, the respective under-frames and the necessary constructions for supporting them impair the air flow which passes across the construction of the grate, by making difficult a correct distribution of the combustion air to the fire bars.

SUMMARY

The present invention solves the drawbacks mentioned before by realizing a plant for waste disposal.

BRIEF DESCRIPTION OF THE DRAWINGS

The characteristics and advantages of the plant according to the present invention will be better clarified and evident from the following description, given by way of example and non limitative, of an embodiment with reference to the annexed figures, in which.

DETAILED DESCRIPTION

Figure 1:
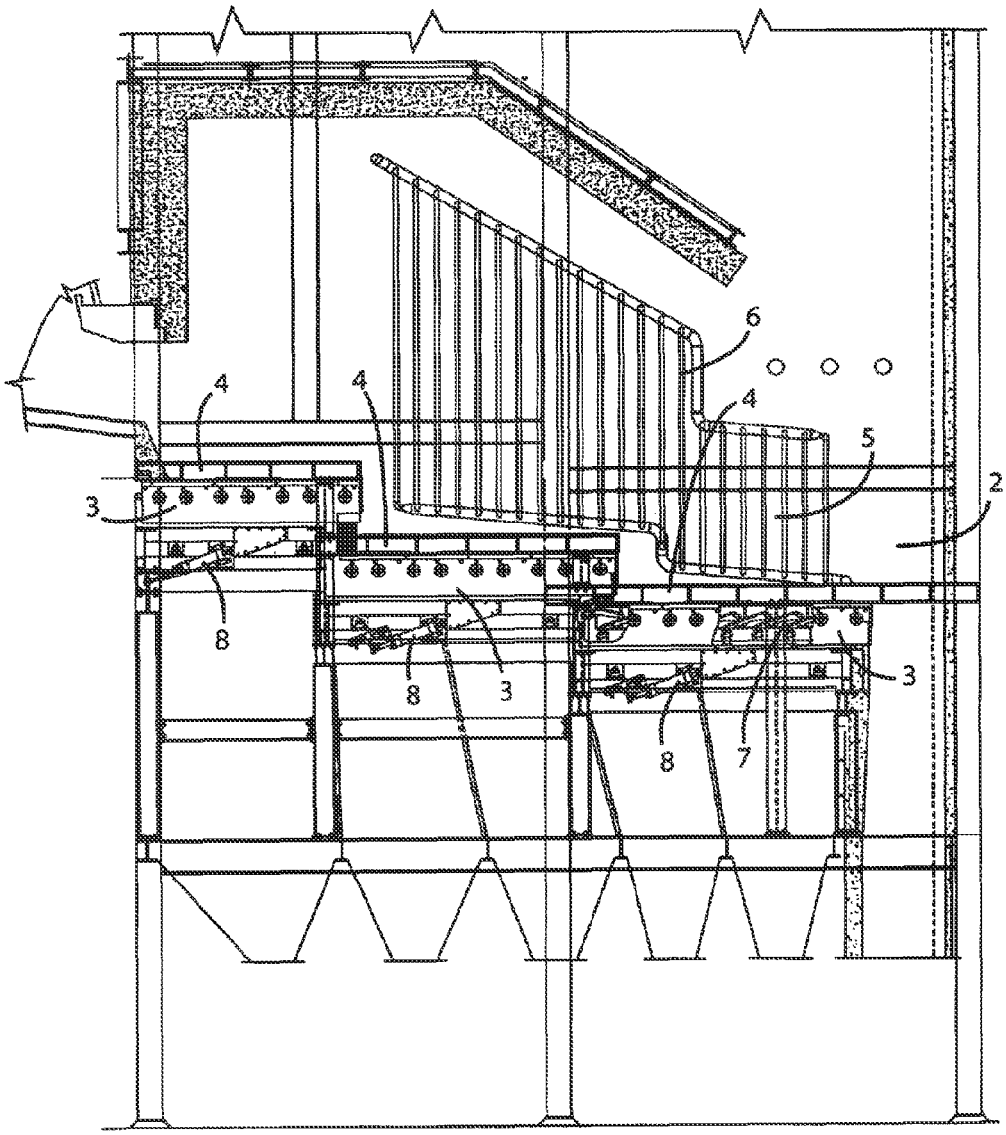
FIG. 1 is a schematic presentation of a waste disposal plant according to the known art, which provides for a three-level combustion grate.
Figure 2:
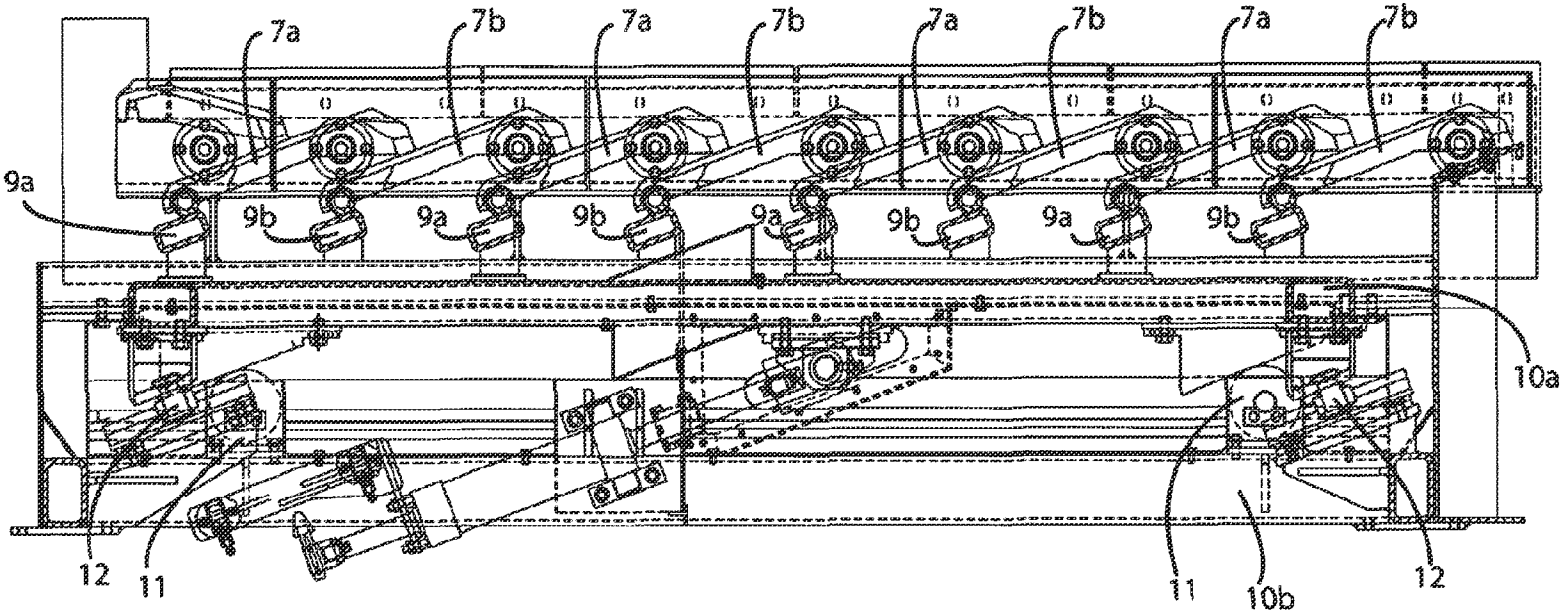
FIG. 2 is a schematic presentation of a handling group of the grate of the plant of FIG. 1.

With reference to cited figures a typical waste disposal plant comprises a combustion chamber 2 inside which the residues disposed on a combustion grate 3 are burned, through which grate an adequate quantity of combustion air is inputted.

The grate makes the lower region of the combustion chamber, above which a beam 4 is present, which has also the function of supporting lateral refractory walls 5. Preferably, the walls of the combustion chamber are completely or partially cooled, through evaporating tube bundles 6 which are protected by the refractory material itself.

The combustion grate comprises at least a handling group made by a plurality of fire bars 7, which are advanced alternatively one with respect to the other by advancing the waste on the grate. In the embodiment shown in figure the handling groups are three disposed offset one with respect to the other, in order to obtain a horizontal discontinuous placement (stepped or with jumps). Alternatively, always within the present invention, it is possible to obtain a slightly inclined placement (up to 15°), without substantial modifications.

Each handling group is actuated by handling means 8 made for example by at least a hydraulic piston. Such handling means allows the alternate movement of fire bars 7 which are divided in movable fire bars 7*a* and fixed fire bars 7*b*, alternately disposed one with respect to the other, resting one on the other on transversal rows according to a longitudinal disposition with alternate steps, respectively with one fixed and one movable.

The movable fire bars are connected to movable beams 9*a* and are bound to a movable frame 10*a*, which is pushed by two pistons, one on each side. The fixed fire bars are in turn connected through fixed beams 9*b* with a fixed frame 10*b* common to all fixed fire bars.

The relative movement between the fixed frame and the movable frame is of a simple alternate translation. The relative movement of the fire bars is of an alternate translation preferably according to a direction inclined of 20° on the horizontal.

The grate is also provided with sliding elements 11 able to determine the sliding between the two frames and elements 12 limiting the movement between them.

In the forward movement the movable fire bar pushes the waste on the back of fixed fire bar 7*b* until causing its fall from the subsequent movable fire bar, and at the same time it drags the waste on its own back. In the rearward movement the waste on the back of the movable fire bar finds an obstacle in the front of the fixed fire bar, and instead of going back, it is pushed downwards onto the back of the fixed fire bar and therefore it is pushed forward in the subsequent movement, by determining the advancement of the waste in each handling group and then on the grate in general.

Such kind of technological solution provides that handling means 8, sliding elements 11 and elements 12 limiting the movement be in fact positioned in mutually remote places of the grate, so making it necessary to dedicate to each of them a separate element of the carrying frame in order to support them. Furthermore, the elements limiting the movement are positioned along the symmetry axis of the module. This kind of mounting makes the rotary portions of the sliding and limiting elements particularly exposed to the unavoidable fall of ashes inside the pressurized volume by increasing the risk of malfunctions. Such placement of the elements makes also difficult the inspection, the maintenance and the lubrication of the rotary parts which must be reached by suitable tubes for the injection of the lubricant. Finally, elements 11 and 12, the respective under-frames and the structures necessary for supporting them impair the air flow which passes through the structure of the grate by rendering a correct distribution of the combustion air to fire bars 7 difficult.

Figure 3:
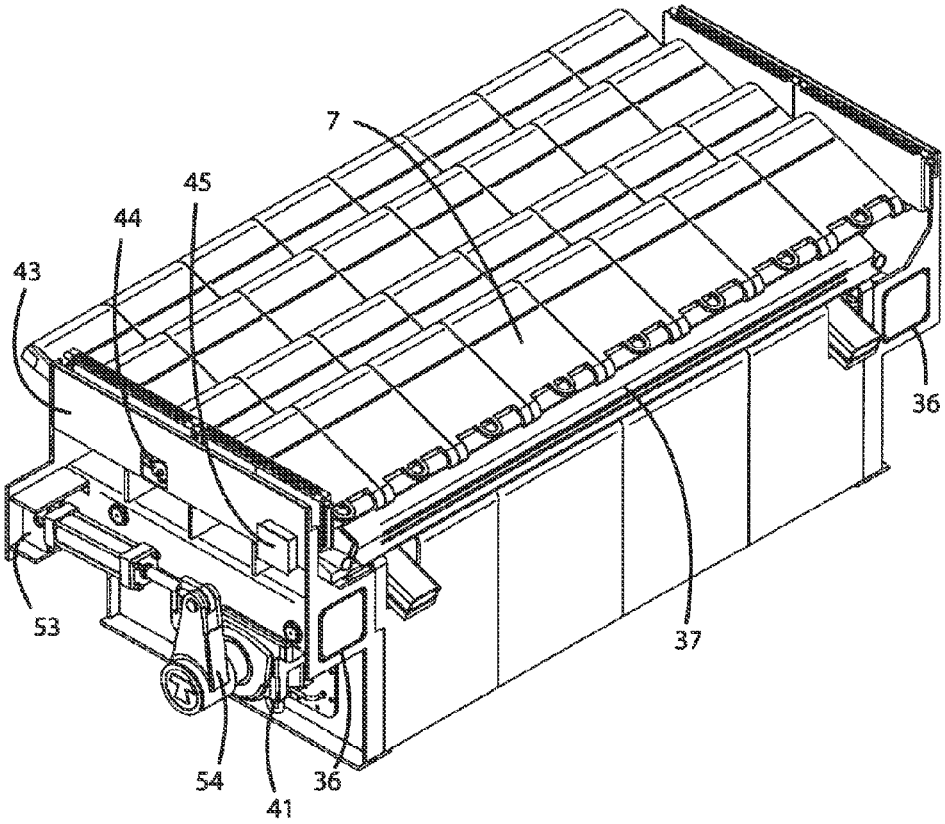
FIG. 3 is a perspective view of the upper portion of the grate according to the present invention, usable in the plant of FIG. 1.
Figure 4:
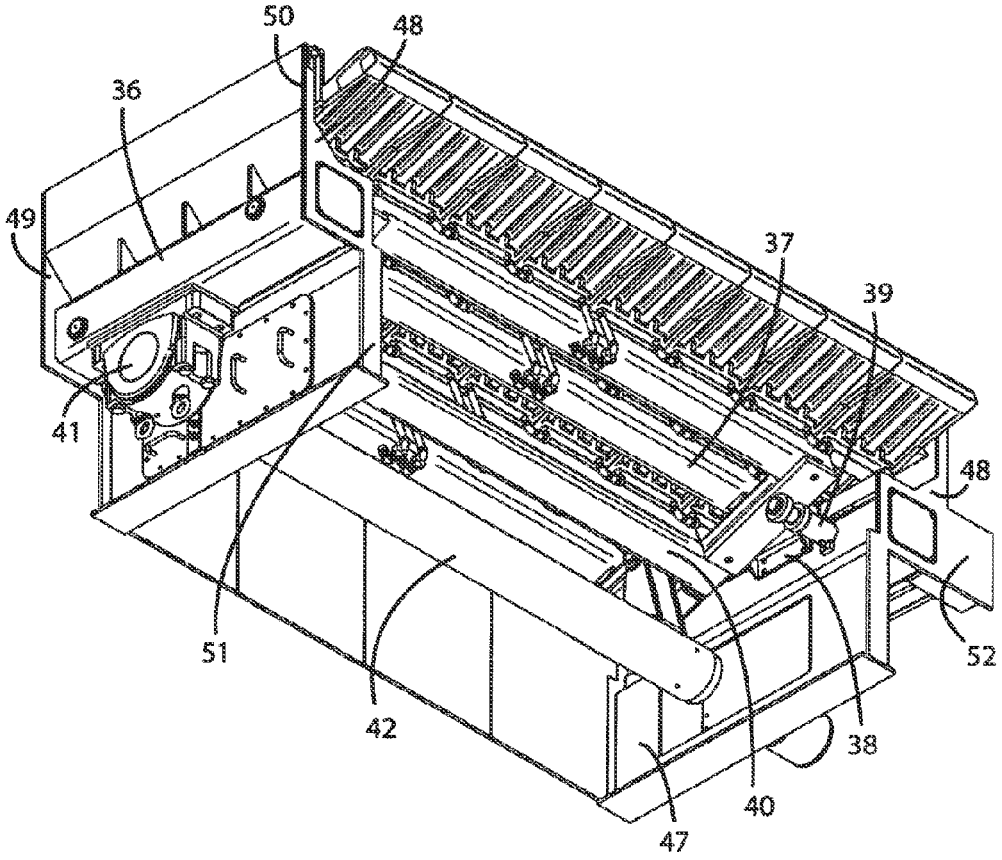
FIG. 4 is a perspective view of the lower portion of the grate according to the present invention usable in the plant of FIG. 1.

In FIGS. 3 and 4 a handling group of the grate is illustrated according to the present invention, comprising a carrying frame including two lateral beams 36 and two transversal cross-beams 37. Lateral beams 36 are preferably realized with a closed square or rectangular cross section and are connected to cross-beams 37 by means of a knot 38 structurally equivalent to a fixed joint, positioned on the upper portion of lateral beams 36 themselves. Knot 38 also comprises a reference (plug or equivalent device—non represented) which permits to precisely position cross-beams 37 with respect to lateral beams 36 during the assembly of the module of the grate. Inside lateral beams 36 axes of wheel assemblies 39 are mounted, which interface the carrying frame with movable frame 40 by permitting the movement of the latter. Wheel assemblies 39 also comprise said limiting elements 12 of the movement. To the lower portion of beams 36 the supports of bearings 41 of actuating shafts 42 are on the contrary fixed.

To the upper portion of beams 36 an upper sheet 43 is fixed. Such sheet separates the lateral plates from the outside and forms the connecting element between the carrying frame and the upper portion of the furnace (non represented), for example comprising thermal insulating panels and respective fixing sheeting. On upper sheet 43 apertures 44 are formed which allow the access to the sealing elements of the lateral plates. Apertures 44 must be air-tightly closed through flanges 45, doors or other closures of equivalent function. To the lower portion of beams 36 a lower non-structural sheet 47 is instead fixed. Sheet 47 together with beams 36 delimits from the two sides of the module of the grate the pressurized volume which provides supply air to fire bars 7. To the front and back ends of beams 36 two flanges 48 and 49 are fixed, whose outer surfaces are made to match in order to couple two successive modules, for example through bolts with gasket or other equivalent air-tight connection. Flanges 48 and 49 are provided with upper extensions 50 and lower extensions 51, which permit to directly couple two successive modules also at upper sheets 43 and of lower sheets 47. Front flanges 48 are finally provided with a lateral extension 52 to which a connection element 53 is fixed, for the hydraulic cylinder moving actuating shaft 42. The handling of the actuating shaft takes place through a lever 54 fitted flush on shaft 42 itself.

Beams 36 as well as having a structural function incorporate the seats of all the inner and outer mechanical parts of the module of the grate, lateral sheets 43 and 47, which make the sides of the module itself and connecting flanges between successive modules.

Due to the fact that the support cross-beams of the fire bars are structural elements in the present invention, the assembly of the carrying frame of each module requires exclusively the coupling of beams 36 specular for the two sides of the module, to cross-beams 37 by means of knot 38, provided with reference elements (non represented) for the correct coupling. On beams 36 nearly all the working operations on the machine tools are further concentrated, which are necessary in order to provide for the assembly of the module of the grate, as beams 36 are integral with the seats of all the inner and outer mechanical parts, flanges 48 and 49 coupling the successive modules and the coupling and reference surfaces to cross-beams 37 (non represented). As beams 36 have a reduced length in order to permit the transport of the modules without resorting to exceptional transport means, they can be worked with reduced times and costs with respect to the completely assembled modules of the today produced grates. The only working operations at the machine tools which are not positioned on beams 36 are those of the coupling surfaces of knot 38 which are integral with cross-beams 37 and which must be referred to the corresponding surfaces on beams 36

The invention claimed is:

1. Waste disposal plant comprising a combustion chamber inside which waste laid on a combustion grate is burnt, which allows entrance of an adequate quantity of combustion air in the chamber, said combustion grate comprising at least a handling group formed by a plurality of fire bars or plates, which move alternatively one with respect to another by advancing the waste on said grate, the handling group permitting alternate movement of the fire bars which are divided in movable fire bars and fixed fire bars, alternately disposed one with respect to another, on transversal rows resting one upon-another according to a longitudinal placement with alternate steps, respectively one fixed and one movable, the movable fire bars being bound to a movable frame, which is pushed through the handling group;

the handling group comprises a carrying frame including at least two lateral beams and at least two cross-beams, the at least two lateral beams being connected to the at least two cross-beams by a joint, positioned on the upper portion of the lateral beams, inside the lateral beams axes being mounted on wheel assemblies interfacing the carrying frame with the movable frame allowing movement of the movable frame, the wheel assemblies incorporating movement limiting elements;

wherein a lower sheet is fixed to a lower portion of the lateral beams, which together with the lateral beams delimits from two sides of a module of the grate pressurized volume which feeds supply air to the fire bars.

2. Waste disposal plant comprising a combustion chamber inside which waste laid on a combustion grate is burnt, which allows entrance of an adequate quantity of combustion air in the chamber, said combustion grate comprising at least a handling group formed by a plurality of fire bars or plates, which move alternatively one with respect to another by advancing the waste on said grate, the handling group permitting alternate movement of the fire bars which are divided in movable fire bars and fixed fire bars, alternately disposed one with respect to another, on transversal rows resting one upon-another according to a longitudinal placement with alternate steps, respectively one fixed and one movable, the movable fire bars being bound to a movable frame, which is pushed through the handling group;

the handling group comprises a carrying frame including at least two lateral beams and at least two cross-beams, the at least two lateral beams being connected to the at least two cross-beams by a joint, positioned on the upper portion of the lateral beams, inside the lateral beams axes being mounted on wheel assemblies interfacing the carrying frame with the movable frame allowing movement of the movable frame, the wheel assemblies incorporating movement limiting elements;

wherein two flanges are fixed to front and back ends of the lateral beams, whose outer surfaces are made to match to couple two successive handling groups;

wherein the flanges are provided with upper and lower extensions, which permit correctly coupling two successive modules at upper sheets and lower sheets.

3. Waste disposal plant comprising a combustion chamber inside which waste laid on a combustion grate is burnt, which allows entrance of an adequate quantity of combustion air in the chamber, said combustion grate comprising at least a handling group formed by a plurality of fire bars or plates, which move alternatively one with respect to another by advancing the waste on said grate, the handling group permitting alternate movement of the fire bars which are divided in movable fire bars and fixed fire bars, alternately disposed one with respect to another, on transversal rows resting one upon-another according to a longitudinal placement with alternate steps, respectively one fixed and one movable, the movable fire bars being bound to a movable frame, which is pushed through the handling group;

the handling group comprises a carrying frame including at least two lateral beams and at least two cross-beams, the at least two lateral beams being connected to the at least two cross-beams by a joint, positioned on the upper portion of the lateral beams, inside the lateral beams axes being mounted on wheel assemblies interfacing the carrying frame with the movable frame allowing movement of the movable frame, the wheel assemblies incorporating movement limiting elements;

wherein two flanges are fixed to front and back ends of the lateral beams, whose outer surfaces are made to match to couple two successive handling groups; and wherein the front flanges are provided with a lateral extension to which a fastening element is fixed for a hydraulic cylinder which moves an actuating shaft.

4. The plant according to claim 3, wherein the handling of the actuating shaft is made by a lever fitted flush to the actuating shaft.

* * * * *